US006233750B1

(12) United States Patent
Donald et al.

(10) Patent No.: US 6,233,750 B1
(45) Date of Patent: May 22, 2001

(54) TOILET BOWL VENTILATING APPARATUS

(76) Inventors: Shane Craig Donald, 654 Jenner Cove, Edmonton, Alberta (CA), T6L 6S1; Weixi Chow, 1009 Lakewood Road, N. Edmonton, Alberta (CA), T6K 3B1

( * ) Notice: Subject to any disclaimer, the term of this patent is extended or adjusted under 35 U.S.C. 154(b) by 0 days.

(21) Appl. No.: 09/489,048

(22) Filed: Jan. 21, 2000

Related U.S. Application Data

(63) Continuation-in-part of application No. 09/130,416, filed on Aug. 6, 1998, now abandoned.

(30) Foreign Application Priority Data

Dec. 31, 1997 (CA) ..... 2226021

(51) Int. Cl.[7] ..... E03D 9/04
(52) U.S. Cl. ..... 4/213
(58) Field of Search ..... 4/213, 216, 217, 4/347–352

(56) References Cited

U.S. PATENT DOCUMENTS 997,442 * 7/1911 Diffenderfer ..... 4/213
2,129,048 * 9/1938 Davis ..... 4/213
2,214,200 * 9/1940 Lowther ..... 4/213
2,846,969 * 8/1958 Herriott ..... 4/213
3,523,309 * 8/1970 Munden ..... 4/213
3,849,808 * 11/1974 Olson et al. ..... 4/213
3,857,119 * 12/1974 Hunnicutt, Jr. ..... 4/213
4,375,704 * 3/1983 Smith ..... 4/213
5,488,741 * 2/1996 Hunnicutt, Jr. ..... 4/213

FOREIGN PATENT DOCUMENTS

1012305 * 6/1977 (CA) .
214098 * 3/1987 (EP) ..... 4/213
2136030 * 9/1984 (GB) ..... 4/213

OTHER PUBLICATIONS

Select Point, 200 Shower Toilet, Product Brochure, 2 Pages, Undated.*

* cited by examiner

*Primary Examiner*—Charles R. Eloshway
(74) *Attorney, Agent, or Firm*—Davis & Bujold, P.L.L.C.

(57) ABSTRACT

A toilet bowl ventilating apparatus includes a housing secured in cantilever fashion to a mounting arm which is adapted to be mounted to toilet seat mounting bolts of a toilet bowl. The housing has a receptacle for filter medium and a fan to draw air through the housing past the filter medium. The mounting arm is secured substantially symmetrically at a mid-point of the housing and has an outwardly and downwardly extending elongated intake passage that extends down into the toilet bowl. The intake passage is flexibly adjustable over 180 degrees to a selected orientation, thereby enabling the intake passage to change orientation depending upon whether the housing is positioned on the left side or the right side of the toilet bowl.

7 Claims, 5 Drawing Sheets

TOILET BOWL VENTILATING APPARATUS

This application is a continuation-in-part of application Ser. No. 09/130,416, filed Aug. 6, 1998, now abandoned.

FIELD OF THE INVENTION

The present invention relates to a toilet bowl ventilating apparatus.

BACKGROUND OF THE INVENTION

Canadian patent 1,012,305 discloses a several embodiments of toilet that are modified to include in their construction a ventilating apparatus. The ventilating apparatus is intended to draw contaminated air and odours from the toilet bowl. Each embodiment includes a hollow toilet seat which serves as a conduit for drawing contaminated air from the toilet bowl. Two alternative mounting positions are illustrated for a blower which promotes the movement of air. One mounting position discloses a toilet tank which is modified by the addition of a partition to create a watertight compartment in which the blower is positioned. Another mounting position discloses a separate blower compartment positioned beneath the toilet tank. The problem with the ventilating apparatus disclosed in Canadian patent 1,012,305, is that it is not capable of being readily retrofit onto an existing toilet.

U.S. Pat. No. 5,488,741 (Hunnicutt Jr.) discloses a toilet bowl ventilating apparatus that consists of a mounting arm with a housing secured in cantilever fashion to the mounting arm. The Hunnicutt ventilating apparatus is more readily adaptable to an existing toilet by securing the mounting arm to toilet seat mounting bolts of a toilet bowl. When retrofitting existing toilets there are often space constraints encountered that require the housing of Hunnicutt to be positioned to one particular side of the toilet. This requires Hunnicutt to either maintain an inventory of both left-handed and right-handed model, or to restrict his sales to either left-handed or right-handed models.

SUMMARY OF THE INVENTION

What is required is a toilet bowl ventilating apparatus that has greater adaptability when retrofitting existing toilets.

According to the present invention there is provided a toilet bowl ventilating apparatus which includes a housing having an interior cavity forming an air flow channel. The air flow channel has an inlet and an outlet. A receptacle is provided for filter medium positioned across the air flow channel between the inlet and the outlet, such that air flowing from the inlet to the outlet must pass through filter medium positioned in the receptacle. A fan communicate with the air flow channel. A power supply is provided. A switch is provided for selectively supplying power from the power supply to the fan, whereby the fan moves air in the inlet, along the air flow channel through the filter medium and out the outlet. An elongate plinth-like mounting arm is provided having a first end and a second end. The first end is secured substantially symmetrically at a mid-point of the housing. The mounting arm has an air flow passage communicating with the inlet and extending from the first end toward the second end. The mounting arm has at least one bolt receiving aperture extending therethrough whereby the mounting arm is mounted to toilet seat mounting bolts of a toilet bowl. The mounting arm has an outwardly and downwardly extending elongated intake passage intersecting the air flow passage, such that the intake passage extends down into the toilet bowl. The intake passage is flexibly adjustable over 180 degrees to a selected orientation, thereby enabling the intake passage to change orientation depending upon whether the housing is positioned on the left side or the right side of the toilet bowl.

The toilet bowl ventilating apparatus, as described above, is readily mounted by means of the feed duct/mounting arm onto the toilet seat mounting bolts of virtually any style of toilet bowl. It is preferred that the power supply be in the form of a battery mounted in the housing with a low voltage battery charging unit periodically recharging the battery. Once the basic teachings is understood, additional features can be added to enhance the performance of the ventilating apparatus. One such additional feature is the provision of a receptacle for receiving fragrance. This receptacle is positioned along the air flow channel downstream of the filter medium. This enables air flowing through the air flow channel to be imbued with fragrance after filtration and prior to discharge back into the room. It is preferred that the filter medium be provided in a removable cartridge.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
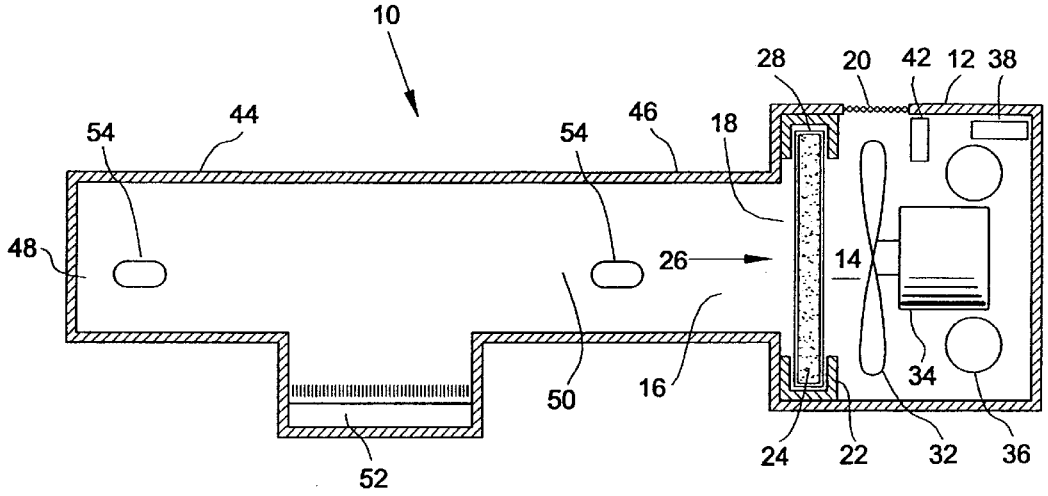
FIG. 1 is a top plan view, in section, of a toilet bowl ventilating apparatus constructed in accordance with the teachings of the present invention.

The preferred embodiment, a toilet bowl ventilating apparatus generally identified by reference numeral 10, will now be described with reference to FIGS. 1 through 7.

Figure 2:
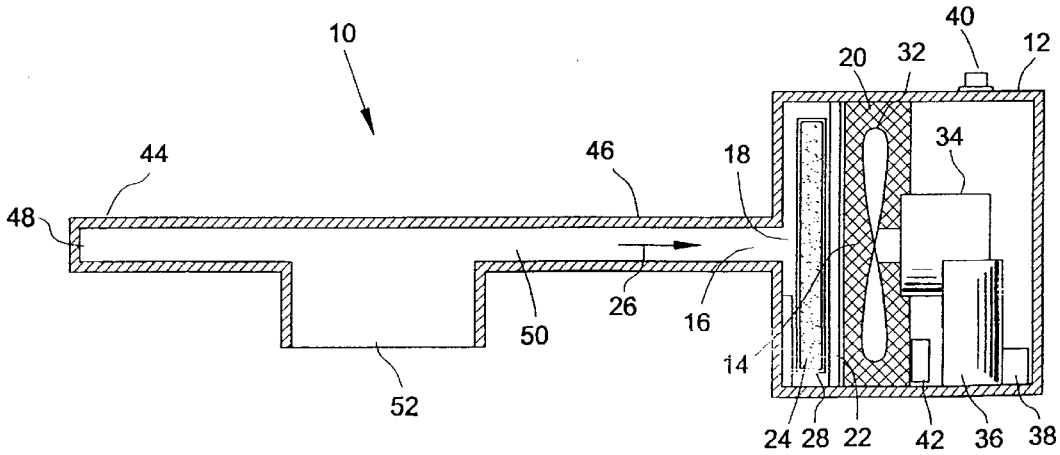
FIG. 2 is a front elevation view, in section, of the toilet bowl ventilating apparatus illustrated in FIG. 1.
Figure 3:
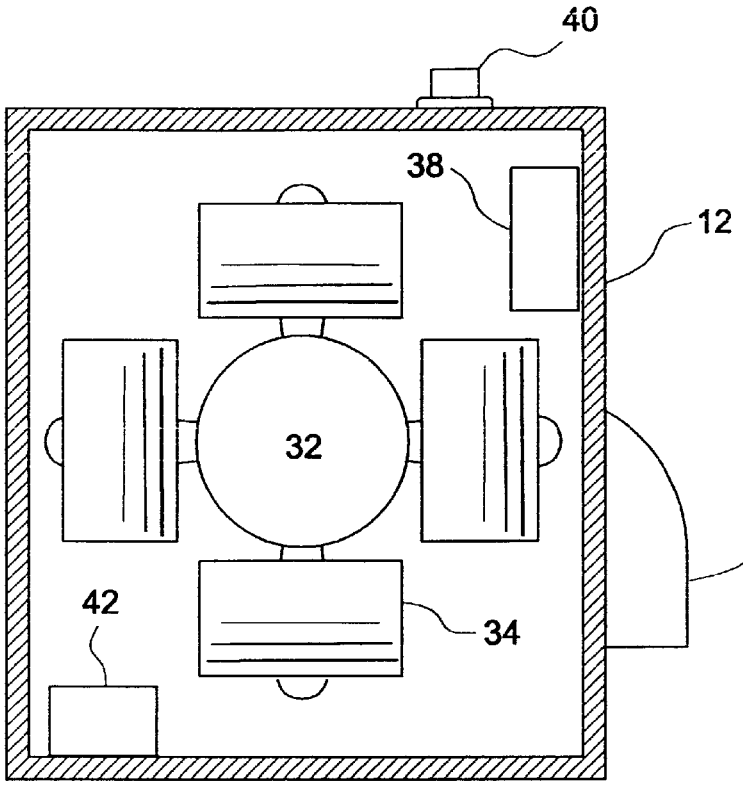
FIG. 3 is a right side elevation view, in section, of the toilet bowl ventilating apparatus illustrated in FIG. 1.
Figure 4:
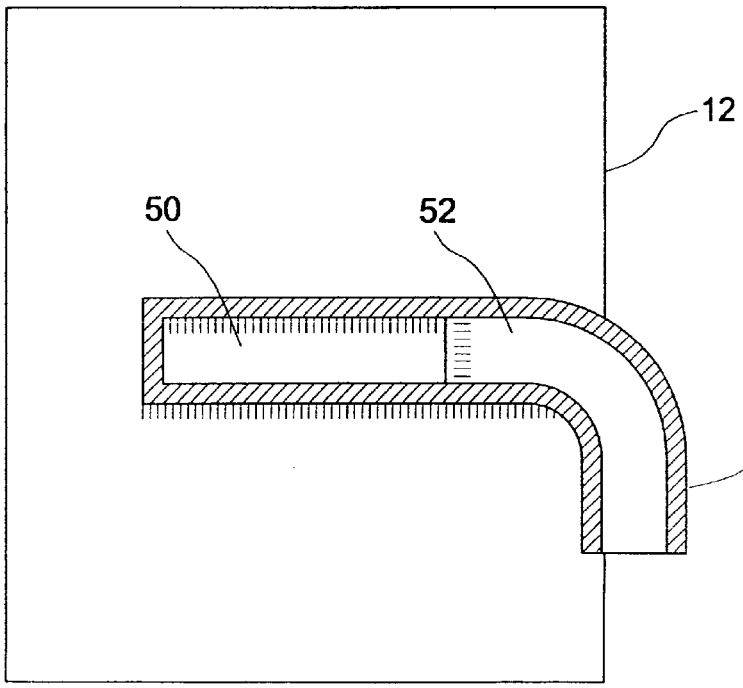
FIG. 4 is a left side elevation view, in section, of the toilet bowl ventilating apparatus illustrated in FIG. 1.
Figure 5:
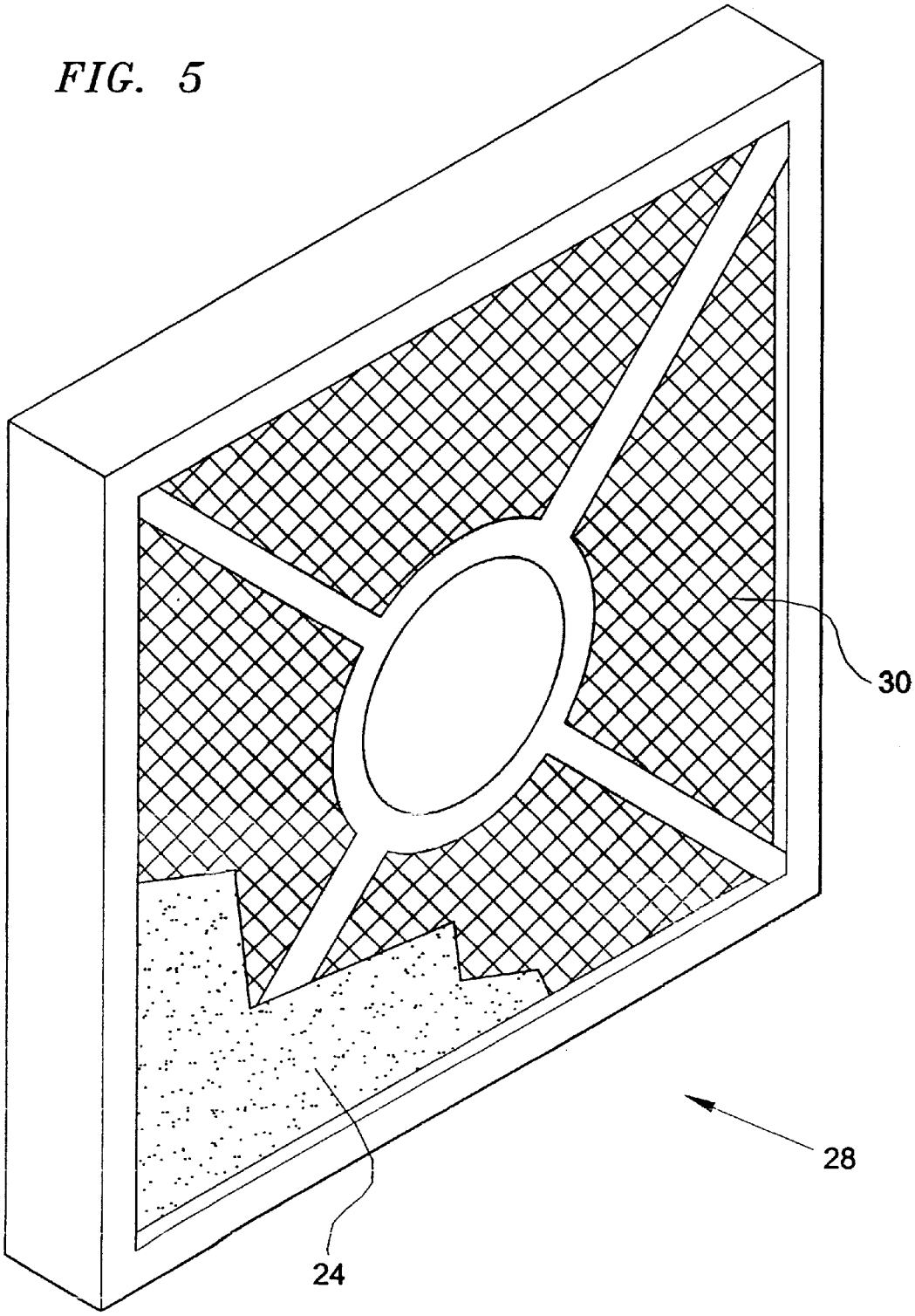
FIG. 5 is a detailed perspective view of a filter cartridge removed from the toilet bowl ventilating apparatus illustrated in FIG. 1.
Figure 6:
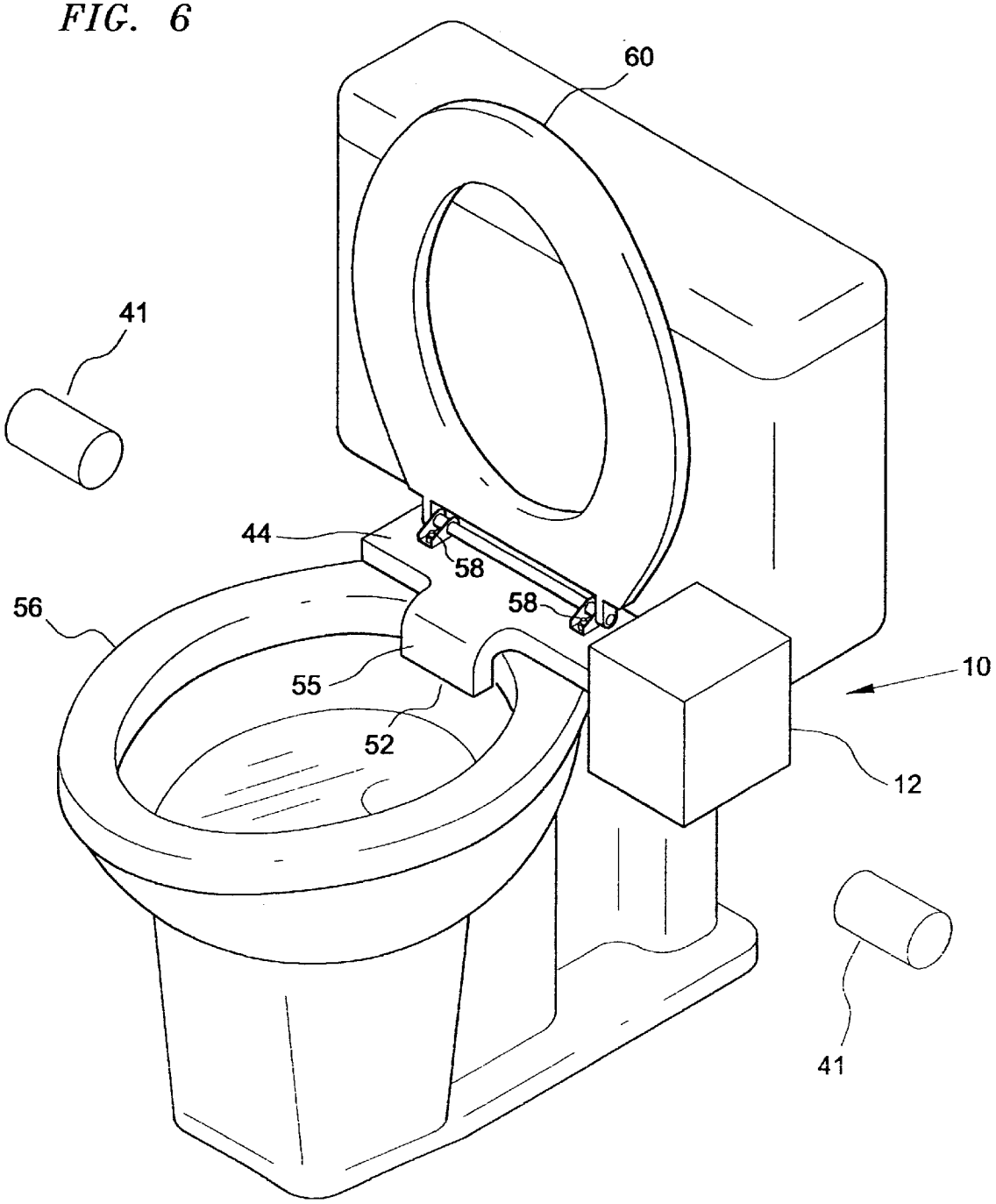
FIG. 6 is a perspective view of the toilet bowl ventilating apparatus illustrated in FIG. 1 mounted onto a toilet bowl with the housing positioned on the right side.
Figure 7:
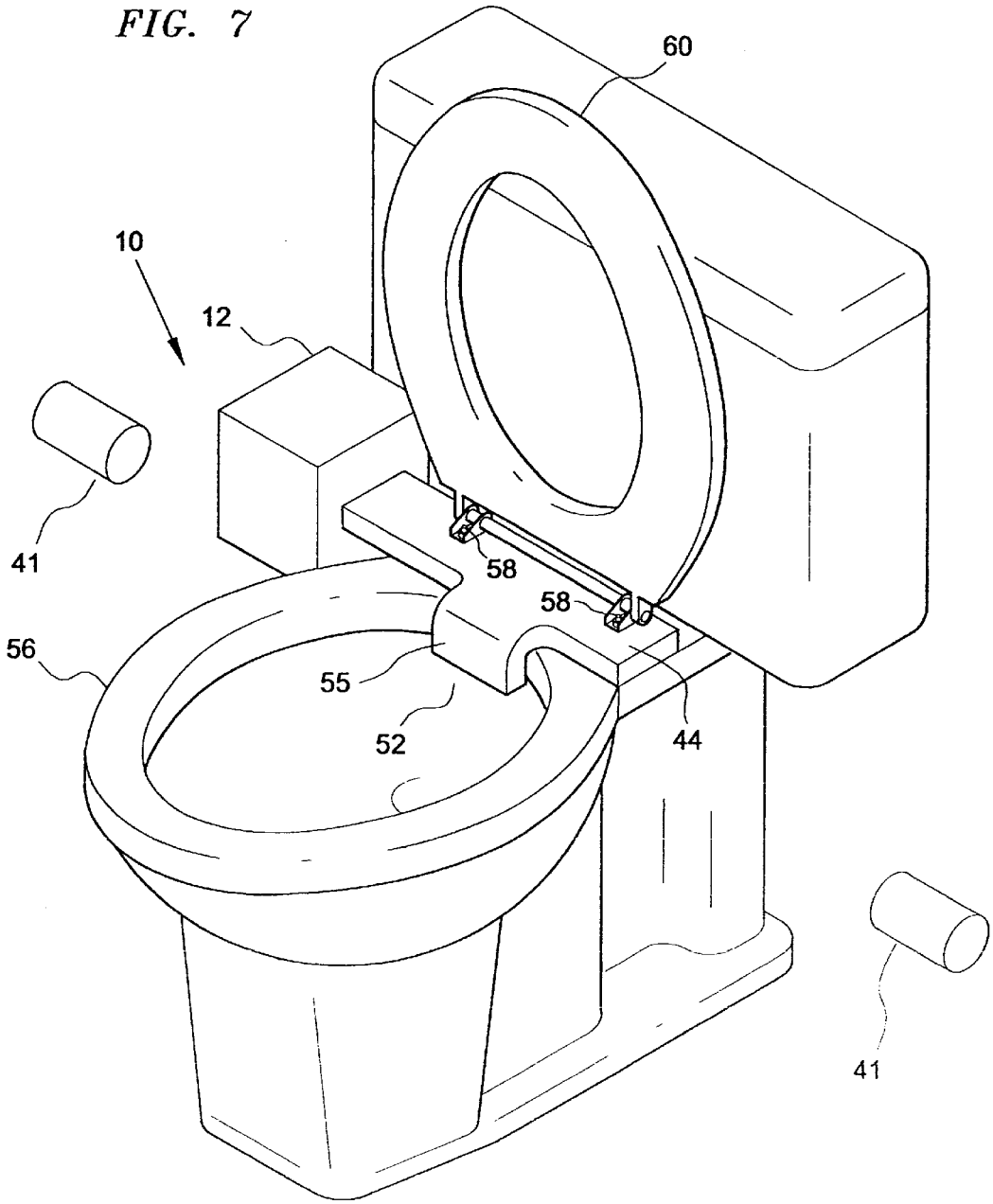
FIG. 7 is a perspective view of the toilet bowl ventilating apparatus illustrated in FIG. 1 mounted onto a toilet bowl with the housing positioned on the left side.

Referring to FIG. 1, toilet bowl ventilating apparatus 10 includes a housing 12 having an interior cavity 14 forming an air flow channel 16. Air flow channel 16 has an inlet 18 and an outlet 20. A receptacle 22 for filter medium 24 is positioned across air flow channel 16 between inlet 18 and outlet 20. Air flowing from inlet 18 to outlet 20, as indicated by arrow 26, must pass through filter medium 24 positioned in receptacle 22. It is preferred that filter medium 24 be positioned in a removable filter cartridge 28 which is positioned in receptacle 22. Referring to FIG. 5, filter cartridge 28 has air permeable sidewalls 30 to confine filter medium 24. There are various materials with known beneficial effects when used as a filter medium, such as activated carbon. Referring to FIG. 1, a fan 32 which includes a miniature drive motor 34 communicates with air flow channel 16. Although a larger industrial unit could be built using a direct AC plug in connection, the version illustrated is a smaller domestic version that uses batteries. A battery 36 is mounted in housing 12 to supply power fan 32. A low voltage alternating current to direct current battery charging unit 38 is also mounted in housing 12. Battery charging unit 38 is coupled with battery 36 and serves to charge battery 36, as required. Referring to FIG. 2, a switch is provided for selectively supplying power from battery 36 to fan 32. Switch can either be a push button style switch, such as indicated by reference numeral 40 or can be triggered by infrared sensors 41, as illustrated in FIGS. 6 and 7. When infrared sensors 41 are used fan 32 is activated as soon as the presence of a person is sensed and the fan continues to operate for 30 seconds after the presence of a person is no longer sensed. The angle at which sensor 41 is positioned has an effect on operation. When the angle is less than 5 degrees, there is a danger that the sensor will be triggered by the seat. When the angle is greater than 30 degrees there is a danger that the sensor will miss detecting the presence of a child. The distance the sensor projects is also of importance. If sensor projects for too great a distance, there is a danger that operation of fan 32 will be triggered by persons walking past the toilet. It has been found that sensors 41 do not need to be constantly on; energy savings can be obtained if sensors 41 are "pulsed" rather than on continuously. It is preferred that two sensors 41 be provided. One of sensors 41 is set to the correct angle when positioned to the left of the toilet bowl and the other of sensors 41 is set to the correct angle when positioned to the right of the toilet bowl. A receptacle 42 is provided for receiving fragrance. Receptacle 42 is positioned along air flow channel 16 downstream of filter medium 24. Referring to FIG. 1, an elongate plinth-like feed duct/mounting arm 44 is provided having a first end 46 and a second end 48. First end 46 is secured to housing 12. Feed duct/mounting arm 44 has an air flow passage 50 communicating with inlet 18 and extending from first end 46 toward second end 48. Feed duct/mounting arm 44 has an elongated intake passage 52 which intersects air flow passage 50. Feed duct/mounting arm 44 has two bolt receiving apertures 54 extending therethrough. Referring to FIG. 4, elongated intake passage 52 has a downwardly extending portion 55. It is preferred that housing 12 and feed duct/mounting arm 44 are a single body molded from polymer plastic.

The use and operation of toilet bowl ventilating apparatus 10 will now be described with reference to FIGS. 1 through 7. Referring to FIG. 6, there is illustrated a toilet bowl 56 which has two upwardly projecting mounting bolts 58 used to secure a toilet seat 60 onto toilet bowl 56. In order to mount toilet bowl ventilating apparatus 10 onto toilet bowl 56, toilet seat 60 is temporarily removed. Feed duct/mounting arm 44 is then mounted onto toilet bowl 56 by extending mounting bolts 58 through bolt receiving apertures 54. Toilet seat 60 is then reinstalled over top of feed duct/mounting arm 44. When installed, downwardly extending portion 55 of intake passage 52 extends down into toilet bowl 56. Housing 12 hangs from mounting arm 44 in a cantilever fashion. Referring to FIGS. 1 and 2, fan 32 can be activated in the absence of a person sitting on toilet seat 60 by pushing button switch 40 to commence a timer controlled activation cycle. Referring to FIGS. 6 and 7, when a person sits on toilet seat 60, fan 32 is triggered by infrared sensors 41 detecting the presence of the person positioned on toilet seat 60. Fan 32 will operate as long as infrared sensors 41 detect the position of the person, and for a 30 second timed duration after the person is no longer sensed. As long as fan 32 remains in operation, air is drawn by fan in through intake passage 52 and along air flow passage 50 to inlet 18. Air passes through inlet 18, along air flow channel 16 through filter cartridge 28 and out through outlet 20. Due to the positioning of fragrance receptacle 42, air passing along air flow channel 16 and out outlet 20 is imbued with fragrance. Whenever the charge in battery 36, which powers fan 32, falls below a preset level, battery charging unit 38 is activated to recharge battery 36. Battery charging unit 38 can be plugged into a household power receptacle with a normal AC/DC adaptor.

Referring to FIG. 7, it is preferred that first end 46 of feed duct/mounting arm 44 be secured substantially symmetrically at a mid-point of housing 12. This is to facilitate housing being positionable on either the left side or the right side of toilet bowl 56. It is also preferred that extending portion 55 of intake passage 52 be flexibly adjustable over 180 degrees to a selected orientation. This enables extending portion 55 of intake passage 52 to change orientation to extend down into toilet bowl 56, regardless of whether housing 12 is positioned to the left side or the right side of toilet bowl 56.

It will be apparent to one skilled in the art that modifications may be made to the illustrated embodiment without departing from the spirit and scope of the invention as hereinafter defined in the claims.

We claim:

1. A toilet bowl ventilating apparatus, including:

a housing having an interior cavity forming an air flow channel, the air flow channel having an inlet and an outlet;

a receptacle for filter medium positioned across the air flow channel between the inlet and the outlet, such that air flowing from the inlet to the outlet must pass through filter medium positioned in the receptacle;

a fan communicating with the air flow channel;

a power supply;

a switch for selectively supplying power from the power supply to the fan, whereby the fan moves air in the inlet, along the air flow channel through the filter medium and out the outlet; and an elongate plinth-like mounting arm having a first end and a second end, the first end being secured at a mid-point of the housing, the mounting arm having an air flow passage communicating with the inlet and extending from the first end toward the second end, the mounting arm having at least one bolt receiving aperture extending therethrough whereby the mounting arm is mountable to toilet seat mounting bolts of a toilet bowl, the mounting arm having an outwardly and downwardly extending elongated intake passage intersecting the air flow passage, such that the intake passage extends down into the toilet bowl, the intake passage being flexibly adjustable over 180 degrees to a selected orientation, thereby enabling the intake passage to change orientation depending upon whether the housing is positioned on the left side or the right side of the toilet bowl.

2. The toilet bowl ventilating apparatus as defined in claim 1, wherein a receptacle for receiving fragrance is positioned along the air flow channel downstream of the filter medium.

3. The toilet bowl ventilating apparatus as defined in claim 1, wherein the power supply is a battery mounted in the housing together with a low voltage alternating current to direct current battery charging unit.

4. The toilet bowl ventilating apparatus as defined in claim 1, wherein the filter medium is disposed in a removable cartridge.

5. The toilet bowl ventilating apparatus as defined in claim 1, wherein the switch includes at least one proximity sensor, whereby power is selectively supplied from the power supply to the fan when a person is detected by the at least one proximity sensor.

6. The toilet bowl ventilating apparatus as defined in claim 5, wherein two proximity sensors are provided, one of the two proximity sensors adapted to detect the presence of a person when the housing is positioned on the left side of the toilet bowl and another of the two proximity sensors adapted to detect the presence of a person when the housing is positioned on the right side of the toilet bowl.

7. The toilet bowl ventilating apparatus as defined in claim 1, wherein the housing and mounting arm form a one piece unit molded from polymer plastic.

* * * * *